US005085592A

United States Patent [19]

Sekiguchi

[11] Patent Number: 5,085,592

[45] Date of Patent: Feb. 4, 1992

[54] CONNECTOR WITH SHORT CIRCUIT AND CONNECTOR ASSEMBLY

[75] Inventor: Shigemi Sekiguchi, Kiryu, Japan

[73] Assignee: Hosiden Corporation, Osaka, Japan

[21] Appl. No.: 645,792

[22] Filed: Jan. 25, 1991

[30] Foreign Application Priority Data

Jan. 25, 1990 [JP] Japan ..... 2-6693[U]

[51] Int. Cl.[5] ..... H01R 13/703

[52] U.S. Cl. ..... 439/188; 200/51.1

[58] Field of Search ..... 439/188; 200/51.1, 51.09

[56] References Cited

U.S. PATENT DOCUMENTS

| | | | |
|---|---|---|---|
| 367,931 | 8/1887 | Runels | 200/51.1 |
| 1,526,102 | 2/1925 | Taft | 200/51.1 |
| 4,358,135 | 11/1982 | Tsuge et al. | 200/51.1 |
| 4,633,048 | 12/1986 | Komatsu | 200/51.1 |
| 4,666,231 | 5/1987 | Sheesley et al. | 439/188 |
| 4,802,861 | 2/1989 | Gaston | 439/247 |

FOREIGN PATENT DOCUMENTS

| | | |
|---|---|---|
| 0354074 | 2/1990 | European Pat. Off. . |
| 737739 | 7/1943 | Fed. Rep. of Germany . |
| 2039421 | 8/1980 | United Kingdom . |

*Primary Examiner*—Neil Abrams

*Attorney, Agent, or Firm*—Pollock, VandeSande and Priddy

[57] ABSTRACT

A connector with a short circuit has an insulator body that defines a contact piece housing compartment open at the front, the front half portion of a fixed contact piece extending forward in the contact piece housing compartment and the rear half portion being received and fixed in the insulator body. An insulating engaging portion is provided which extends a predetermined length forwardly of the front end of the fixed contact piece. A movable contact piece is disposed with its rear end portion received and fixed in the insulator body in side-by-side relation to the fixed contact piece, the front end portion of the movable contact piece extending forwardly of the insulating engaging portion. The intermediate poriton of the movable contact piece is bent so that it makes elastic contact with the fixed contact piece. When the mating connector is inserted into this connector, an insulating engaging portion or movable contact piece of the former is displaced out of contact with its fixed contact piece and then the tip of the movable contact piece of the latter slides over the insulating engaging portion of the mating connector and gets into contact with its fixed contact piece.

8 Claims, 6 Drawing Sheets

CONNECTOR WITH SHORT CIRCUIT AND CONNECTOR ASSEMBLY

BACKGROUND OF THE INVENTION

The present invention relates to a connector with a short circuit which has at least one pair of contacts and normally holds them in a shorted state but, when engaged with a mating connector, releases them from that state. The invention also pertains to a connector assembly adapted for interconnecting a pair of such connectors.

If a pair of contacts of a connector are not terminated but remain open when it is not connected to the mating connector, it is liable to pick up noise; to avoid this, a connector with a short circuit has been employed. The conventional connector with a short circuit is of the type wherein a pair of contacts to be connected to those of the mating connector and a switch (composed of a fixed contact piece and a movable contact piece), which is turned OFF when the connector is engaged with the mating connector, are both housed in the connector housing and the both contact pieces of the switch are electrically connected to the pair of contacts inside or outside of the connector housing. However, such a prior art connector requires a large number of parts and is complicated in construction, and hence is bulky and costly.

SUMMARY OF THE INVENTION

It is therefore an object of the present invention to provide a connector with a short circuit which is small in the number of parts used, small-sized and low-cost, and a connector assembly adapted for interconnecting a pair of such connectors.

The connector with a short circuit according to the present invention includes: an insulator body with a contact piece housing compartment open in the front; a fixed contact piece having its rear half portion partly projecting out of the body but secured thereto and having its front half portion disposed in the contact piece housing compartment lengthwise thereof; an insulating engaging portion projecting forwardly of the tip of the fixed contact piece; and a movable contact piece having its rear half portion partly projecting out of the body but secured thereto and having its front half portion disposed along the fixed contact piece in the contact piece housing compartment and making resilient contact with the front half portion of the fixed contact piece.

When this connector is engaged with the mating connector, the insulating engaging portion abuts against and resiliently displaces a movable contact piece of the mating connector to disengage it from a fixed contact piece of the mating connector, and at the same time, the movable contact piece of the connector abuts against and is resiliently displaced by an insulating engaging portion of the mating connector, and hence is disengaged from the fixed contact piece.

DESCRIPTION OF THE PREFERRED EMBODIMENTS

Figure 1:
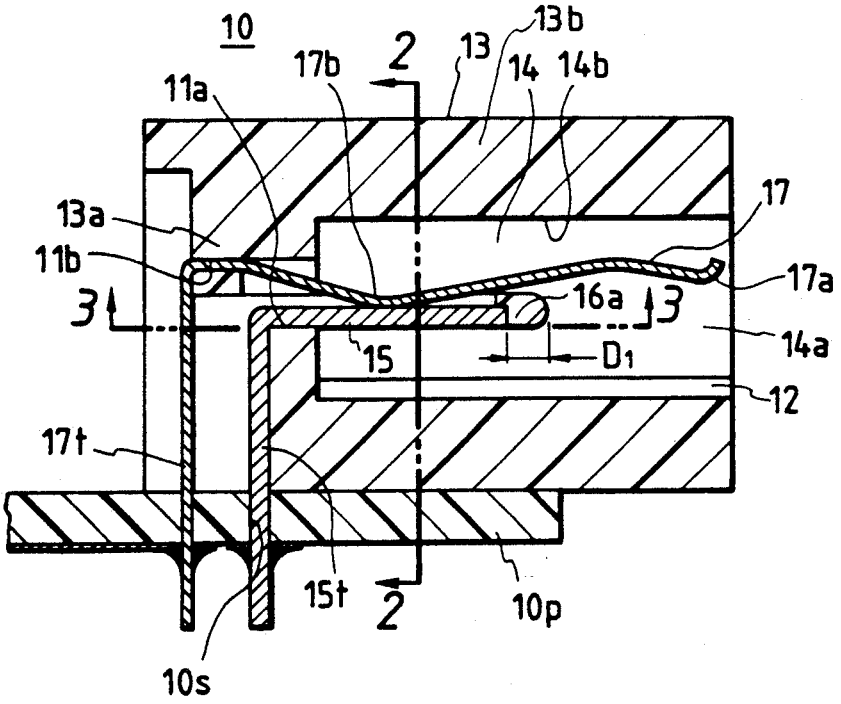
FIG. 1 is a sectional view illustrating a first embodiment of the connector of the present invention.
Figure 2:
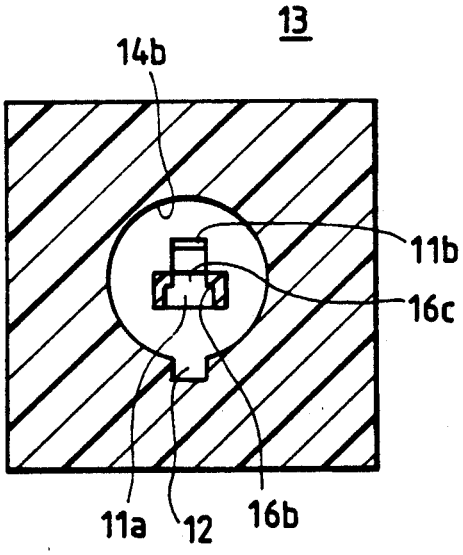
FIG. 2 is a sectional view of a body 13 taken on the line 2—2 in FIG. 1.
Figure 3:
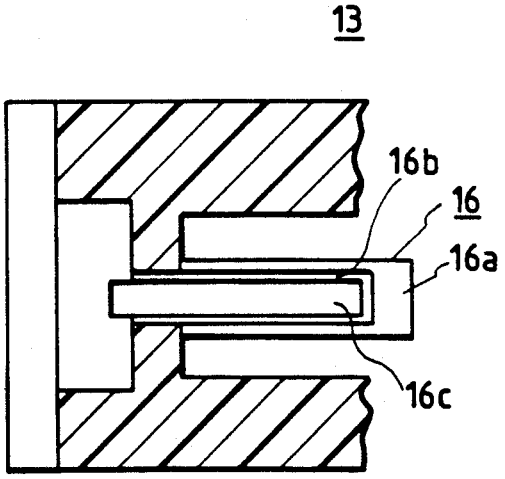
FIG. 3 is a sectional view of the body 13 taken on the line 3—3 in FIG. 1.

FIGS. 1 through 3 illustrate a first embodiment of the present invention as applied to a connector which is fixedly mounted on a printed board, as indicated generally by 10. As shown in FIG. 1, there are held in an insulator body 13 a strip-like L-shaped fixed contact piece 15 and a springy strip-like movable contact piece 17 which make resilient contact with each other at at least one point. In the first embodiment, as depicted in FIGS. 1 and 2, the insulator body 13 is substantially rectangular parallelepipedic in shape and has a square-sectioned tubular portion 13*b* which has formed therein a contact piece housing compartment 14 extending rearward from an opening 14*a* in the front of the body 13. The contact piece housing compartment 14 receives the mating connector which is indicated by 20 in FIGS. 4 through 6 and which is inserted into the compartment 14 through the opening 14*a*. The inner wall surface 14*b* of the contact piece housing compartment 14 is so formed as to define the rotational angular position of the mating connector 20 about its axis. In the first embodiment shown in FIG. 1 the contact piece housing compartment 14 is cylindrical and has in its inner wall surface 14*b* a positioning groove 12 extending axially thereof.

The rear wall of the insulator body 13 constitute a base portion 13*a* for holding the contact pieces 15 and 17. In the base portion 13*a* there are formed a first slot 11*a* which communicates with the contact piece housing compartment 14 and a second slot 11*b* which also communicates with the compartment 14 but is thinner than, spaced apart from and parallel to the first slot 11*a*. The L-shaped fixed contact piece 15 is inserted into the first slot 11*a* from the back of the body 13 and fixed therein, with the front end portion of the contact piece 15 extending in the contact piece housing compartment 14 substantially to the center thereof in its axial direction. A terminal portion 15*t* of the fixed contact piece 15 abuts against and extends along the outer wall surface of the base portion 13*a* and projects out from the underside of the body 13. The strip-like springy movable contact piece 17 is inserted into the second slot 11*b* from the opening 14*a* of the contact piece housing compartment 14 and a terminal portion 17*t* of the contact piece 17 is bent at right angles to the same direction as the terminal portion 15*t* of the fixed contact piece 15 in spaced parallel relation thereto. The movable contact piece 17 extends to the vicinity of the opening 14*a* and its free end is curved upward to form a curved portion 17*a*. The movable contact piece 17 is bent generally in an extended S-letter shape so that its intermediate portion forms a slightly downward protrusion 17*b*, which makes resilient contact with the fixed contact piece 15 at all times..

A rectangular frame-like support piece 16 extends from the inner wall surface of the body base portion 13*a* in the axial direction thereof. The frame-like support piece 16 has a window 16*c* and a stepped portion 16*b* all around it. The fixed contact 15, when inserted into the slot 11*a*, is fitted into the stepped portion 16*b* of the frame-like support piece 16 and, in this example, the underside of the fixed contact piece 15 is substantially flush with the underside of the support piece 16. The tip end portion of the frame-like support piece 16 forms an insulating engaging portion 16*a*, which protrudes a predetermined length $D_1$ from the tip of the fixed contact piece 15 toward the opening 14*a*. The downward protrusion 17*b* of the movable contact piece 17 makes resilient contact with the top of the fixed contact piece 15 in the window 16*c* of the frame-like support piece 16. The terminal portions 15*t* and 17*t* of the contact pieces 15 and 17 are inserted into, for example, holes 10S made in a printed-circuit board 10P and soldered to printed circuits on the underside of the board 10P.

Figure 4:
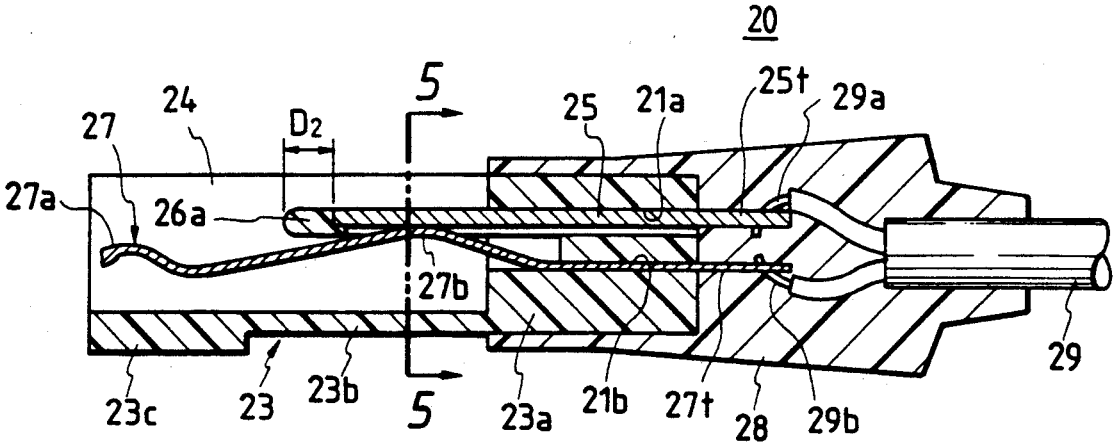
FIG. 4 is a sectional view illustrating a second embodiment of the connector of the present invention.
Figure 5:
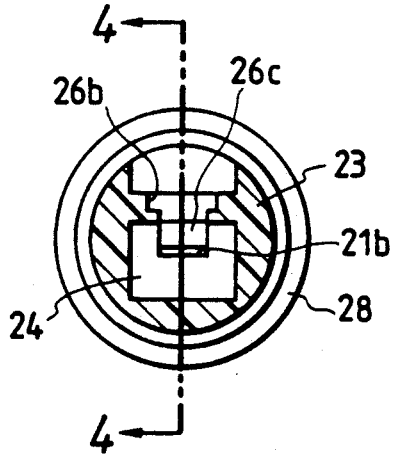
FIG. 5 is a front view of the connector shown in FIG. 4.
Figure 6:
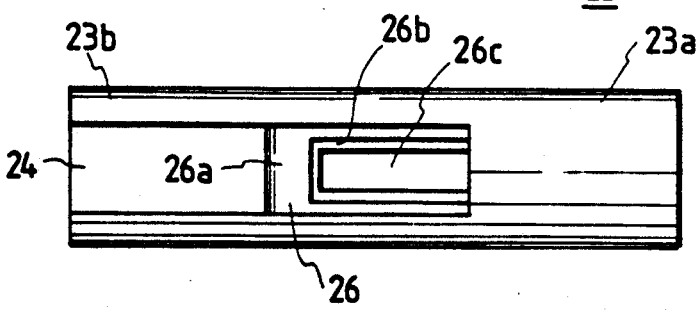
FIG. 6 is a plan view of a body 23 in the second embodiment.

FIGS. 4 through 6 illustrates a second embodiment of the present invention applied to a connector which is connected to the connector of the first embodiment. The connector according to the second embodiment, indicated generally by 20, has a columnar insulator body 23 which is inserted into the contact piece housing compartment 14 of the connector 10 of the first embodiment. The insulator body 23 has a base portion 23*a* at the rear thereof and a cylindrical portion 23*b* extending forwardly from the base portion 23*a* in its axial direction, and the cylindrical portion 23*b* has a square-sectioned contact housing compartment 24 open at the top thereof. On the underside of the cylindrical portion 23*b* there is formed integrally therewith a key 23*c* which extends rearward from the front end of the cylindrical portion 23*b* axially thereof and is fitted into the positioning groove 12 of the connector 10 of the first embodiment.

The body base portion 23*a* has a first slot 21*a* which extends therethrough axially thereof and a second slot 21*b* which also extends through the base portion 23*a* axially thereof under the first slot 21*a* in spaced parallel relation thereto. The connector 20 has a frame-shaped support piece 26 formed integrally therewith and extending from the inner wall of the base portion 23*a* in its axial direction forwardly of the first slot 21*a* to substantially the center of the contact piece housing compartment 24. The frame-shaped support piece 26 may be of the same shape as the frame-shaped support piece 16 used in the first embodiment, but in the second embodiment the support piece 26 has both sides formed integrally with both side inner walls of the cylindrical portion 23*a*.

A strip-like fixed contact piece 25 is inserted through the first slot 21*a* from behind and its portion projecting out forwardly of the base portion 23*a* is fitted into a stepped portion 26*b* formed around a window 26*c* made in the frame-shaped support piece 26 as in the first embodiment. The tip end portion of the frame-shaped support piece 26 protrudes a predetermined length $D_2$ forwardly of the tip of the fixed contact piece 25 to form an insulating engaging portion 26*a*. A strip-like, resilient movable contact piece 27 is inserted into the second slot 21*b* from the inside of the contact piece housing compartment 24. The free end portion of the movable contact piece 27 lies near an open end 24*a* of the cylindrical portion 23*b* and forms a downward curved portion 27*a*. The movable contact piece 27 is bent generally in an extended S-letter shape so that its intermediate portion forms a slightly upward protrusion 27*b*, which make resilient contact with the fixed contact piece 25 in the window 26*c* of the frame-shaped support piece 26. Signal lines 29*a* and 29*b* of a cable 29 are connected to those terminal portions 25*t* and 27*t* of the contact pieces 25 and 27 projecting out rearward of the base portion 23*a*, and these connecting portions are embedded in an insulating cover 28 formed by molding and extending from the outer periphery of the base portion 23*a* to the outer periphery of the cable 29.

Figure 7A:
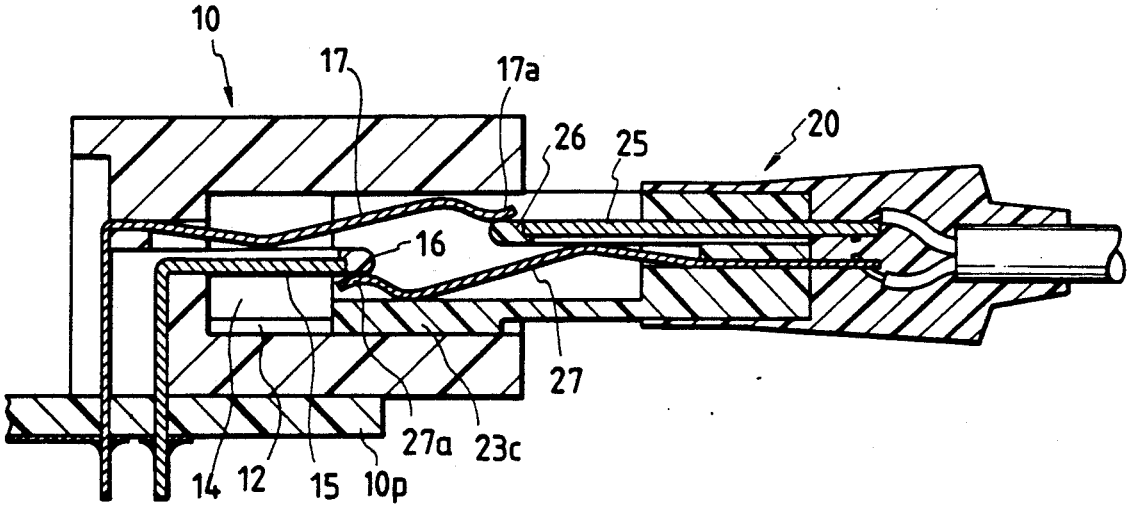
FIG. 7A is a sectional view showing the process of connecting the connectors of the first and second embodiments.

FIG. 7A shows how to connect the connector 20 of the second embodiment to the connector 10 of the first embodiment. As the cylindrical portion 23*b* of the connector 20 is inserted into the contact piece housing compartment 14 of the connector 10 with the key 23*c* of the former fitted in the positioning groove 12 of the latter, the curved portions 17*a* and 27*a* of the movable contact pieces 17 and 27 of the connectors 10 and 20 abut against the insulating engaging portions 26*a* and 16*a* of the mating connectors 20 and 10, respectively, by which they are resiliently displaced out of contact with the fixed contact pieces 15 and 25.

Figure 7B:
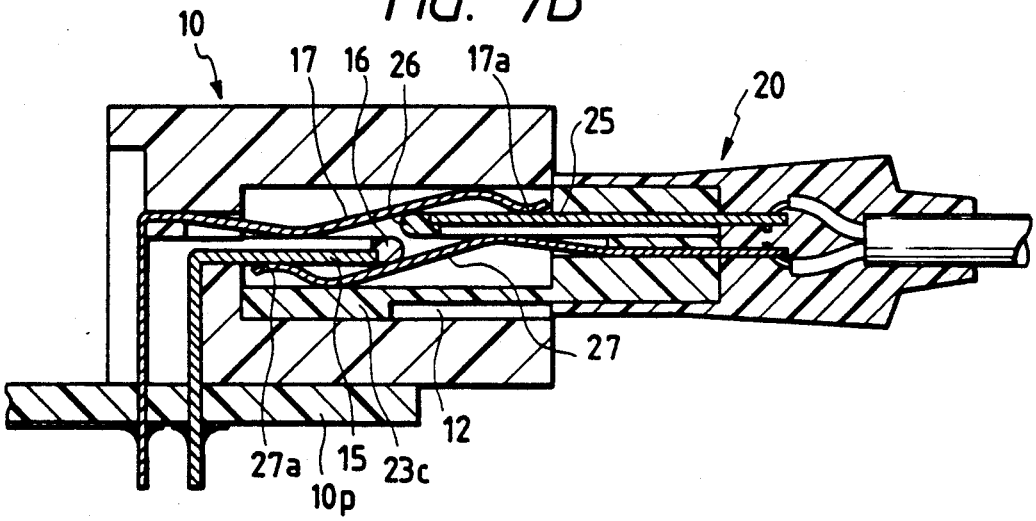
FIG. 7B is a sectional view showing their connected state.

When the connector 20 is further inserted, the top of the insulating engaging portion 26*a* of the connector 20 and then the top of the fixed contact piece 25 sequentially make sliding contact with the downward curved portion 17*a* at the free end of the movable contact piece 17 of the connector 10 as shown in FIG. 7B. On the other hand, the upward curved portion 27*a* at the free end of the movable contact piece 27 of the connector 20 resiliently slides into contact with the underside of the insulating engaging portion 16*a* of the connector 10 and then with the underside of the fixed contact piece 15. Finally, the front end of the body 23 of the connector 20 abuts against the end wall of the contact piece housing compartment 14 of the connector 10 and the front end of the cover 28 of the connector 20 abuts against the front end face of the body 13 of the connector 10, bringing the fixed contact piece 15 or 25 of the connector 10 or 20 into resilient contact with the movable contact piece 27 or 17 of the connector 20 or 10.

The connector 20 can be pulled out of the connector 10 by reversing the above-mentioned procedure. That is, the movable contact piece 17 or 27 of the one connector 10 or 20 id disengaged from the fixed contact piece 25 or 15 of the other connector 20 or 10 and then automatically makes resilient contact with the fixed contact 15 or 25.

FIGS. 8 through 11 illustrate a third embodiment of the present invention applied to a fixed type connector, which is indicated generally by 30. The connector 30 is composed of an insulating body 33 having formed integrally therewith a disc-shaped base portion 33a and a sleeve 33b extending axially from the outer marginal edge of the front end face of the base portion 33a, and a cylindrical shielding metal cover 33M having its rear end portion fitted in the sleeve 33b and extending axially thereof. The metal cover 33M has two diametrically opposite ground terminals 33T extending from the rear end of the cover 33M in its axial direction. The ground terminals 33T project out of the rear end of the sleeve 33b, extend along both sides of the base portion 33a of the body 33 and project out of the rear end face of the base portion 33a. The inner wall surface of the metal cover 33M defines a contact piece housing compartment 34.

A frame-shaped support piece 36 extends from the front of the base portion 33a to substantially the center of the contact piece housing compartment 34 axially thereof. The third embodiment has two pairs of fixed and movable contact pieces 35 and 37 and the frame-shaped support piece 36 has two axially spaced-apart parallel windows 36c each having a stepped portion all around it. The two fixed contact pieces 35 are engaged with the two windows 36c through two spaced-apart first slots 31a which extend through the base portion 33a axially thereof in the same plane and communicate with the two windows 36c of the support piece 36, respectively. The tip end portion of the frame-shaped support piece 36 forms an insulating engaging portion 36a protruding forwardly of the fixed contact pieces 35.

The two movable contact pieces 37, which are disposed opposite the two fixed contact pieces 35 and extend to the vicinity of an open end 34a of the contact piece housing compartment 34, are fixedly fitted in two spaced-apart second slots 31b which extend through the base portion 33a axially thereof in the same plane. Each of the movable contact pieces 37 has at its tip a curved portion 37a curved to move away from an imaginary plane of extension of the corresponding fixed contact piece 35. The intermediate portion of each movable contact piece 37 is bent in an extended S-letter shape to form a protrusion 37b which makes resilient contact with the corresponding fixed contact piece 35 in the window 36c.

Furthermore, in the third embodiment, a protective support 32 extends from the front of the base portion 33a of the body 33 to the front of the metal cover 33M between the two movable contact pieces 37 and the inner surface of the metal cover 33M. The protective support 32 has such a shape as formed by cutting an imaginary column of an external diameter smaller than the inner diameter of the metal cover 33M along a plane 32c parallel to the axis thereof, leaving a thickness smaller than the radius of the imaginary column. Between the outer peripheral surface of the protective support 32 and the inner surface of the metal cover 33M is defined a gap 34a for partly receiving a cylindrical metal cover of the mating connector described later. The aforementioned surface 32c of the protective support 32 faces the frame-shaped support piece 36 in spaced parallel relation thereto across the movable contact pieces 37, and in the surface 32c there are formed two spaced-apart guide grooves 32a. The gap between the frame-shaped support piece 36 and the protective support 32 defines a slot 34b for housing the movable contact pieces 37, and this gap is of a size large enough to receive a frame-shaped support piece 46 of a connector 40 described later on (in respect of FIGS. 12 through 15).

The width of each guide groove 32a in the surface 32c is slightly greater than the width of each movable contact piece 37, and hence is capable of receiving the movable contact piece 37. The guide groove 32a has its two sides widened at the tip end portion of the protective support 32 to form an engaging recess 32b. The engaging recess 32b receives an engaging protrusion 37c protrusively provided on either side of the corresponding movable contact piece 37 at the tip end thereof, thereby preventing the tip of the movable contact piece 37 from getting out of the guide groove 32a laterally thereof.

Since the two movable contact pieces 37 are disposed inside of the marginal edges of the protective support 32, there is no fear of a part of the mating connector striking against the side of either movable contact piece 37. Another function of the protective support 32 is to define the position of engagement with the mating connector, and this will be described later in connection with a fourth embodiment of the present invention.

Figure 8:
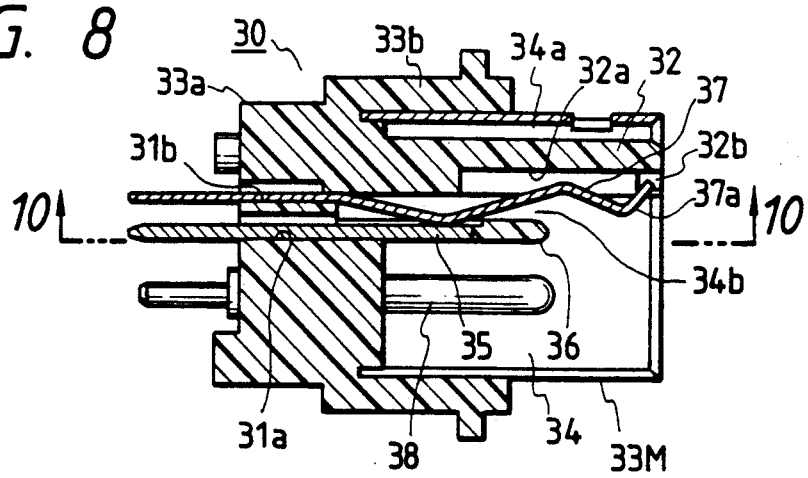
FIG. 8 is a sectional view illustrating a third embodiment of the connector of the present invention.
Figure 9:
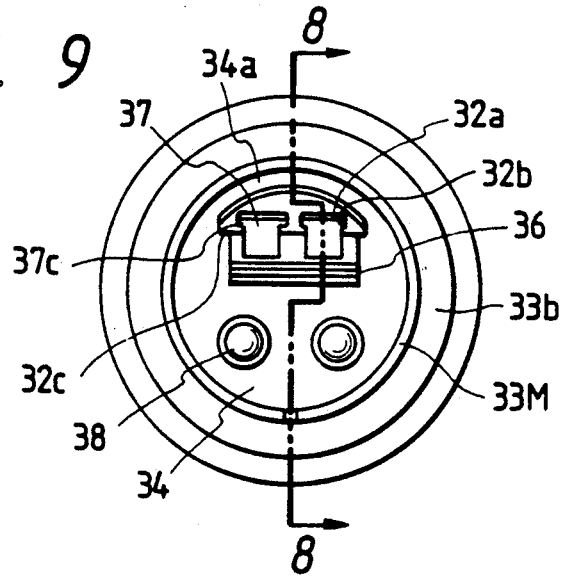
FIG. 9 is its front view.
Figure 10:
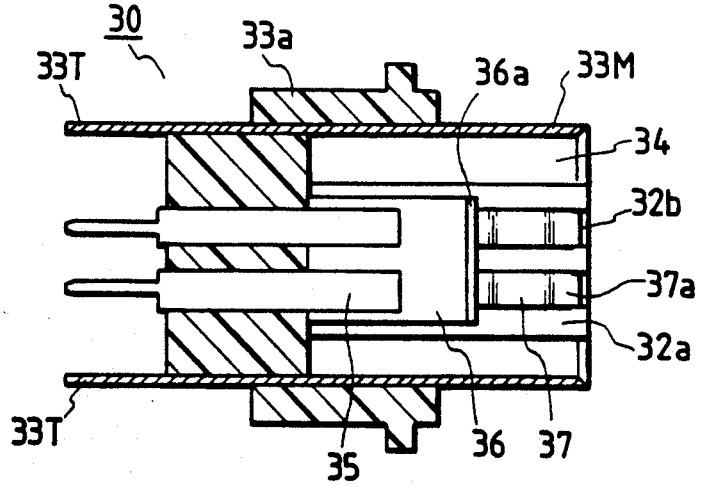
FIG. 10 is a sectional view taken on the line 10—10 in FIG. 8.
Figure 11:
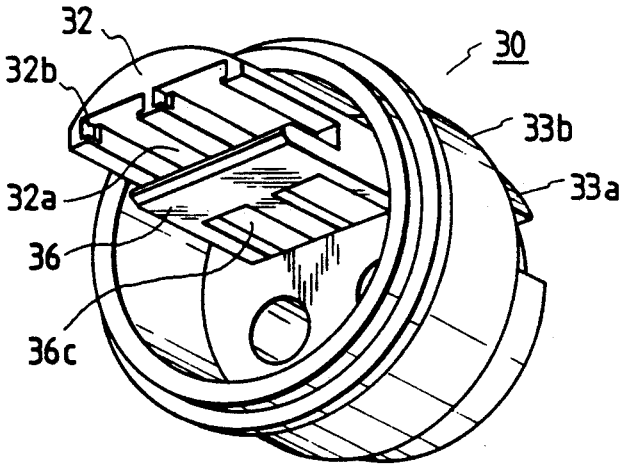
FIG. 11 is a perspective view showing a body 33 of the connector of the third embodiment.

Moreover, the third embodiment described above includes two pin contacts 38, which are spaced apart and extend through the body base portion 33a axially thereof on the side opposite from the movable contact pieces 37 with respect to the frame-shaped support piece 36, as depicted in FIGS. 8 and 9.

Figure 15:
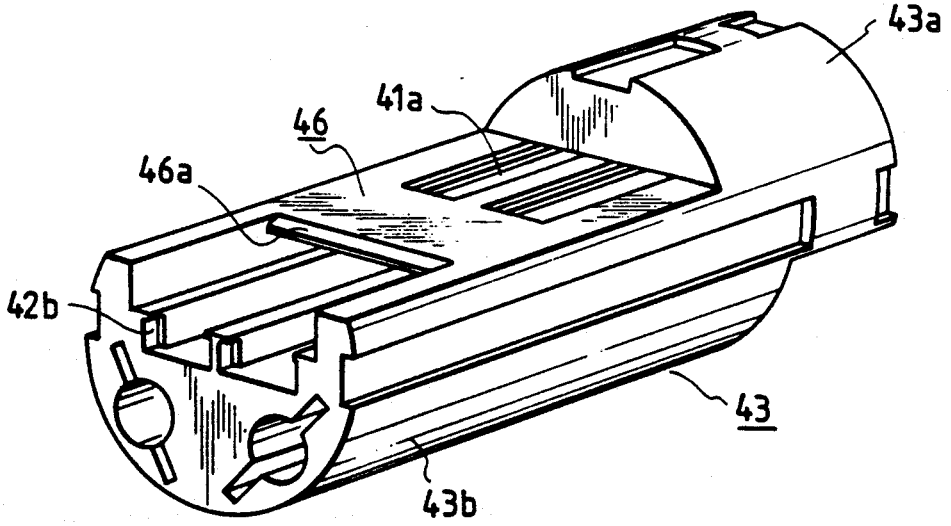
FIG. 15 is a perspective view of a body 43 of the connector of the fourth embodiment.
Figure 12:
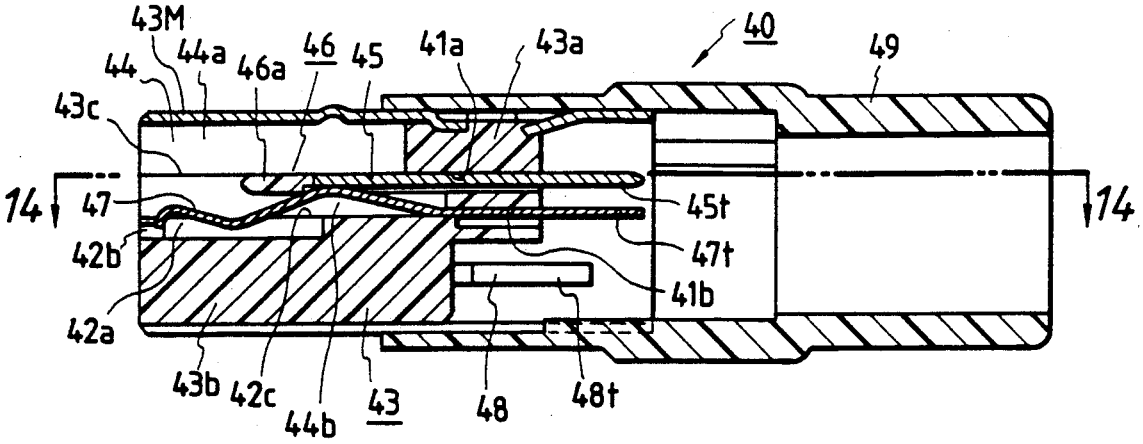
FIG. 12 is a sectional view illustrating a connector of a fourth embodiment of the present invention which is connected to the connector of the third embodiment.
Figure 13:
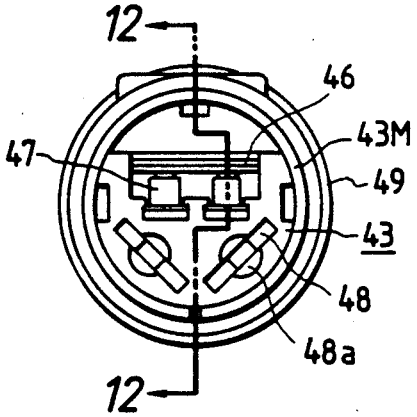
FIG. 13 is a front view of the connector shown in FIG. 12.
Figure 14:
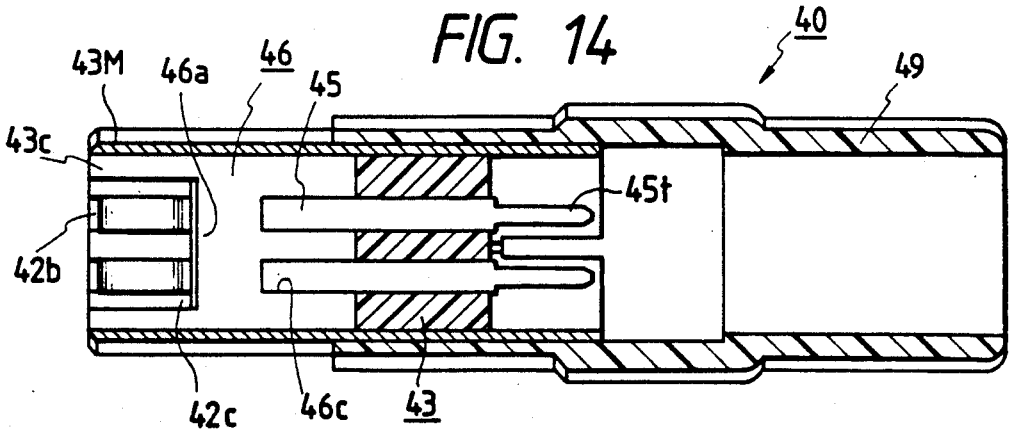
FIG. 14 is a sectional view taken on the line 14—14 in FIG. 12.

FIGS. 12 through 15 illustrates a fourth embodiment of the present invention, which is used as a mating connector 40 of the fixed type connector 30 of the third embodiment described above. As shown in FIG. 15, an insulator body 43 of the connector 40 is composed of a complementary portion 43b of such a shape as is formed by removing a portion corresponding to protective support 32 in the third embodiment from a column along a plane 43c parallel to the axis thereof, and a base portion 43a forming a part of the column at the back of the complementary portion 43b. In this embodiment the base portion 43a is also removed behind the complementary portion 43b. The insulator body 43 is entirely received in a cylindrical metal cover 43M which covers it extending from its front end face and beyond its rear end face, thus defining between the insulator body 43 and the complementary portion 43b a positioning hole 44a for receiving the protective support 32 in the third embodiment.

In the insulator body 43 there is formed a slot 44b which extends from the front end face of the complementary portion 43b axially thereof in parallel to the aforementioned surface 43c to the base portion 43a and is narrower than the surface 43c. The slot 44b defines a frame-shaped support piece 46. The width and the position of slot 44b are determined so that it receives the frame-shaped support piece 36 in the third embodiment described previously with respect to FIGS. 8 through 11. The slot 44b forms a part of a contact piece housing compartment 44 together with the hole 44a. The slot 44b communicates with the hole 44a, thereby defining an insulating engaging portion 46a at the tip end portion of the frame-shaped support piece 46. That is, in the fourth embodiment both side marginal edges of the frame-shaped support piece 46 are contiguous to both side portions of the complementary portion 43b as in the second embodiment.

In the bottom 42c of the slot 44b there are formed two spaced-apart guide grooves 42a which extend axially in parallel to each other. Each guide groove 42a is open in the front end face of the complementary portion 43b, where the groove 42a is formed deeper than the bottom 42c of the slot 44b to form an engaging recess 42b. Further, the complementary portion 43b has two spaced-apart contact receiving holes 48a which extend from the front end to the rear end of the complementary portion 43b in its axial direction.

The frame-shaped support piece 46 has two windows 46c which extend axially thereof in spaced and parallel relation to each other. Two first slots 41a extend from the two windows 46c and pass through the base portion 43a. The windows 46c have fitted therein two strip-like fixed contact pieces 45 inserted through the first slots 41a. There are formed two second slots 41b which extend from the bottom 42c of the slot 44b and pass through the base portion 43a. The second slots 41b receive two movable contact pieces 47 inserted thereinto from the front thereof. Each movable contact 47 has an S-letter shape with its intermediate portion extended gently to form an upward protrusion 47b, which makes resilient contact with the corresponding one of the fixed contact pieces 45 in the window 46c. Each movable contact piece 47 has at its tip end a curved portion 47a extending in the direction opposite from the surface 43c and an engaging protrusion 47c formed at the tip of the curved portion 47a is engaged with the engaging recess 42b formed in the guide groove 42a at the front end thereof. The two contact receiving holes 48a have each installed therein a thin fork-shaped contact 48.

The rear end portions of the fixed contact pieces 45, the movable contact pieces 47 and the fork-shaped contacts 48 project out of the rear end face of the body 43, forming terminals 45t, 47t and 48t, respectively. These terminals are connected to signal lines of a cable (not shown) and then the rear half portion of the metal cover 43M is fixed in an insulating cap 49.

In the case of connecting the connector 40 of the fourth embodiment to the connector 30 of the third embodiment, the tip end portion of the former cannot be inserted into the metal cover 33 of the latter unless the rotational angular position of the hole 44a of the connector 40 agrees with the rotational angular position of the protective support 32 of the connector 30. This precludes the possibility of damaging the connectors by connecting them at wrong angular positions. When inserting the tip end portion of the connector 40 into the metal cover 33M of the connector 30 while holding them at the correct angular relation to each other, their insulating engaging portions 46a and 36a abut against the curved portions 37a and 47a of the movable contact pieces 37 and 47 of the mating connectors 30 and 40 and press them into the guide grooves 32a and 42a, respectively, by which the movable contact pieces 37 and 47 are resiliently displaced out of contact with the fixed contact pieces 35 and 45. When having slid past the insulating engaging portions 46a and 36a of the mating connectors, the curved portions 37a and 47a of the movable contact pieces 37 and 47 move into contact with the fixed contact pieces 45 and 35. On the other hand, the pin contacts 38 of the connector 30 are each inserted into the contact receiving hole of the connector 40, wherein it is held by the fork-shaped contact 48.

In the third and fourth embodiments the metal covers 33M and 43M are shown to be cylindrical but they may also be square-sectioned. In such an instance, the metal covers can be formed so that they are engaged with each other only at a predetermined rotational angular position. It is also easy for those skilled in the art to design the shapes of the insulator bodies 33 and 43 in accordance with the shape of the metal covers 33M and 43M.

In any connectors of the embodiments described above, it is also possible to change the timing for opening their short circuits and the order thereof by changing the lengths and shapes of the movable contact pieces, the lengths of the fixed contact pieces and the lengths of the insulating engaging portions.

While in the above the insulating engaging portions 16a, 26a, 36a and 46a are described to be formed integrally with the bodies 13, 23, 33 and 43 so that they extend into the contact piece housing compartments 14, 24, 34 and 44, the present invention is not limited specifically to such structures but is applicable to structures in which the insulating engaging portions are provided independently of the connector bodies.

As described above, according to the present invention, it is possible to perform, with at least one pair of fixed and movable contacts, the function of contacts for the connection to the mating connector and the function of a short circuit switch for turning ON and OFF the contacts therebetween. Consequently, the present invention afford substantial reduction of the number of parts used, and hence offers small, low-cost connectors with a short circuit.

It will be apparent that many modifications and variations may be effected without departing from the scope of the novel concepts of the present invention.

What is claimed is:

1. A connector with a short circuit, comprising:

an insulator body having a contact piece housing compartment open at at least its front;

fixed contact piece means fixed in said insulator body, with its front half portion extending toward said opening in said contact piece housing compartment;

insulating engaging means provided in a manner to extend a predetermined length forwardly of the tip of said fixed contact piece means; and movable contact piece means having a rear end portion which is fixed in said insulator body in spaced relation to said fixed contact piece means, a front end portion which is disposed in side-by-side relation to said fixed contact piece means in said contact piece housing compartment and extends beyond said insulating engaging means toward said opening, and an intermediate portion which is normally held in elastic contact with said fixed contact piece means but is pushed out of contact therewith by the insertion of a mating connector;

said insulating engaging means including a frame-shaped support piece extending from said insulator body into said contact piece housing compartment and having a window and an insulating engaging portion formed in a tip end portion of said frame-shaped support piece, said fixed contact piece means being fitted in said window of said frame-shaped support piece, and said movable contact piece means making elastic contact with said fixed contact piece means in said window.

2. The connector of claim 1, wherein the tip of said movable contact piece means is bent in a direction opposite from a plane containing said fixed contact piece means.

3. The connector of claim 1, wherein said contact piece housing compartment is defined by a tubular portion formed integrally with said insulator body and having its peripheral wall partly opened a predetermined length in its axial direction from its front end.

4. The connector of claim 1, wherein said insulating engaging means includes an insulating engaging portion having its both side portions formed integrally with both side inner walls of said tubular portion.

5. The connector of claim 1, wherein said contact piece housing compartment is formed inside of a tubular metal cover mounted on said insulator body.

6. A connector with a short circuit, comprising:

an insulator body having a contact piece housing compartment open at at least its front, said contact piece housing compartment being formed inside of a tubular metal cover mounted on said insulator body;

fixed contact piece means fixed in said insulator body, with its front half portion extending toward said opening in said contact piece housing compartment;

insulating engaging means provided in a manner to extend a predetermined length forwardly of the tip of said fixed contact piece means; and movable contact piece means having a rear end portion which is fixed in said insulator body in spaced relation to said fixed contact piece means, a front end portion which is disposed in side-by-side relation to said fixed contact piece means in said contact piece housing compartment and extends beyond said insulating engaging means toward said opening, and an intermediate portion which is normally held in elastic contact with said fixed contact piece means but is pushed out of contact therewith by the insertion of a mating connector;

said insulating engaging means including a frame-shaped support piece extending from said insulator body and having a window and an insulating engaging portion formed in a tip end portion of said frame-shaped support piece, said fixed contact piece means being fitted in said window and making elastic contact with said movable contact piece means in said window; and said insulator body having a protective support extending axially in said contact piece housing compartment in side-by-side relation to said movable contact piece means on the side opposite from said frame-shaped support piece, a surface of said protective support facing said movable contact piece means having a guide groove for receiving said movable contact piece means when it is displaced.

7. A connector with a short circuit, comprising:

an insulator body having a contact piece housing compartment open at at least its front, said contact piece housing compartment being formed inside of a tubular metal cover mounted on said insulator body;

fixed contact piece means fixed in said insulator body, with its front half portion extending toward said opening in said contact piece housing compartment;

insulating engaging means provided in a manner to extend a predetermined length forwardly of the tip of said fixed contact piece means; and movable contact piece means having a rear end portion which is fixed in said insulator body in spaced relation to said fixed contact piece means, a front end portion which is disposed in side-by-side relation to said fixed contact piece means in said contact piece housing compartment and extends beyond said insulating engaging means toward said opening, and an intermediate portion which is normally held in elastic contact with said fixed contact piece means but is pushed out of contact therewith by the insertion of a mating connector;

said insulator body having a base portion which has inserted therethrough and fixed therein said fixed contact piece means and said movable contact piece means, and a base extension having an axially extending flat surface and extending from said base portion along a part of an inner side wall of said contact piece housing compartment so that a hole is formed between said flat surface and the inner wall surface of said tubular metal cover for receiving a part of said mating connector, said base extension having formed therein a slot extending axially from a front end thereof to said base portion in parallel to said flat surface, for receiving said movable contact piece means;

an outer wall of said slot defining said flat surface being removed from the front end of said base extension to substantially the center thereof in its axial direction to open said slot to said hole, thereby defining said insulating engaging means in the front end portion of said outer wall of said slot, and a portion of said slot facing said insulating engaging means having formed therein a guide groove extending from the front end of said base extension axially thereof for receiving said movable contact piece means when it is displaced.

8. The connector of claim 7, wherein means is provided for engaging the tip end portion of said movable contact piece means and said guide groove with each other.

* * * * *